United States Patent [19]

Perkins, Jr.

[11] 4,266,105

[45] May 5, 1981

[54] BIASING MEANS FOR COMBINATION ACTUATOR

[75] Inventor: Norman P. Perkins, Jr., Westminster, Md.

[73] Assignee: Gould Inc., Rolling Meadows, Ill.

[21] Appl. No.: 3,134

[22] Filed: Jan. 15, 1979

[51] Int. Cl.[3] ..... H01H 9/20

[52] U.S. Cl. ..... 200/50 A; 200/325; 335/167; 335/172

[58] Field of Search ..... 200/50 A, 50 R, 50 AA, 200/50 B, 50 C, 318–328; 335/172, 167, 168, 169

[56] References Cited

U.S. PATENT DOCUMENTS 3,311,720 3/1967 Johnson ..... 200/50 A 4,068,200 1/1978 Krueger ..... 335/172

*Primary Examiner*—J. V. Truhe

*Assistant Examiner*—Morris Ginsburg

*Attorney, Agent, or Firm*—Harold Huberfeld; Jerome M. Berliner; Bernard Gerb

[57] ABSTRACT

A multi-pole molded case circuit breaker is provided with an interlock, including a forwardly biased actuator, that automatically operates a common trip bar to trip position when the front cover of the molded case is open. With the cover closed, the actuator Zis accessible for pivoting in a first direction to operate the trip bar to trip position. A single coil spring wound around the actuator is compression loaded to bias the actuator forward and is torsionally loaded to bias the actuator opposed to said first direction.

8 Claims, 10 Drawing Figures

FIG. 3
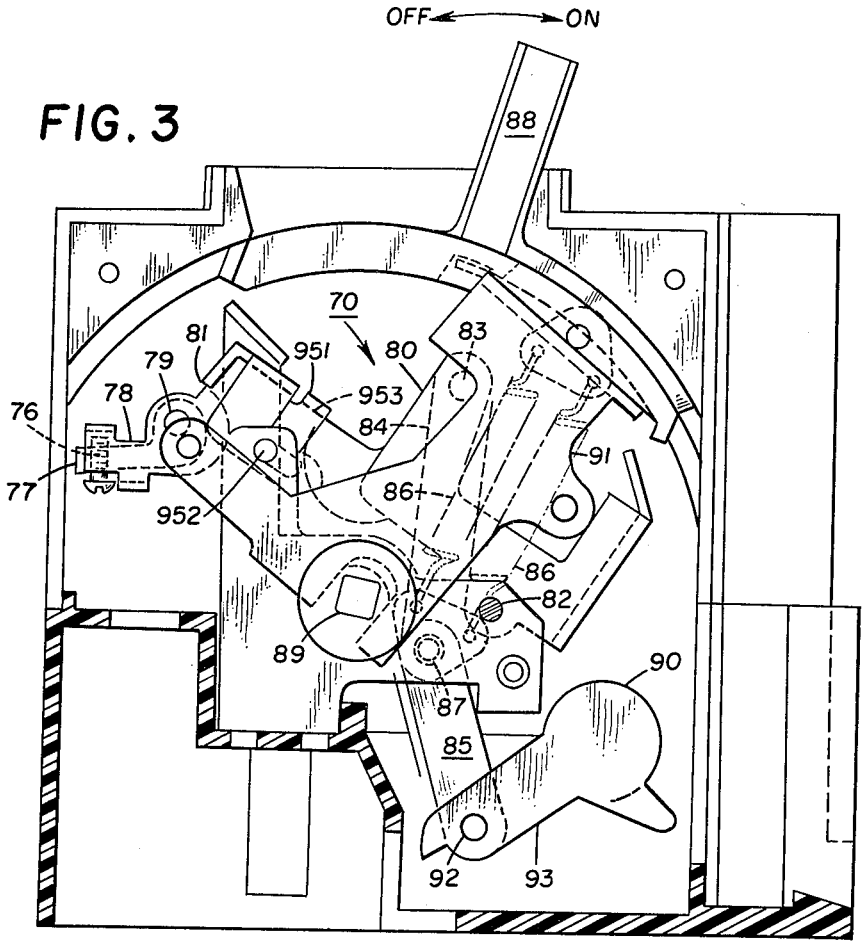
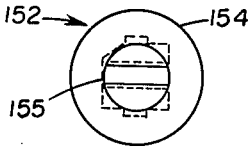
FIG. 10
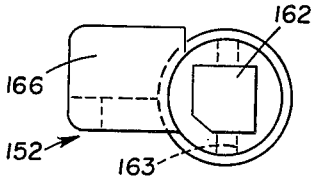
FIG. 7
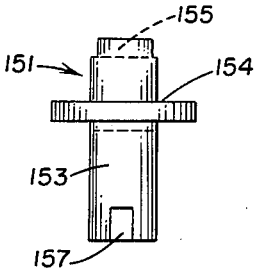
FIG. 9
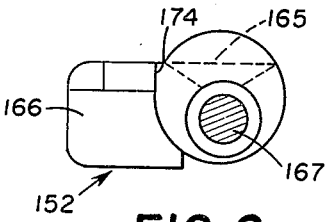
FIG. 6
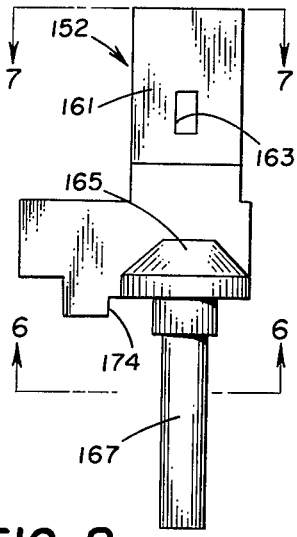
FIG. 8

BIASING MEANS FOR COMBINATION ACTUATOR

This invention relates to molded case circuit breakers in general and more particularly is an improvement over the Combination Cover Interlock and Trip Actuator means described in U.S. Pat. No. 4,068,200 issued Jan. 10, 1978 to K. T. Krueger.

With increased utilization of relatively high voltages and/or high capacity power sources, the importance of safety features for circuit breakers has become more significant. It is especially important that the cooperating contacts of electrical switches be open when they are being serviced. In this connection molded case circuit breakers have often been mounted in metal boxes with the combination being interlocked so that the box cover cannot be opened when the circuit breaker is closed. However, this has only been a partial solution for safety requirements in connection with servicing of circuit breakers.

Thus, in accordance with teachings of the instant invention, a molded case circuit breaker is provided with interlock means so constructed that when the front cover of the molded housing is removed the circuit breaker is automatically tripped and cannot be reset until the cover is closed. This interlock means is so constructed that the actuator therefor is also accessible from outside of the housing even with the cover thereof closed, and operation of this actuator in a first direction is effective to trip the circuit breaker for test purposes. To assure that the actuator does not interfere with resetting of the circuit breaker a biasing spring is provided to urge the actuator opposite to said first direction. This same spring biases the actuator forward and furnishes a tripping force when the front cover is opened.

Accordingly, a primary object of the instant invention is to provide a novel cover interlock and manual trip means for a molded case circuit breaker.

Another object is to provide a circuit breaker in which a single actuator is used as a cover interlock and as a test trip element.

Still another object is to provide novel biasing means for a single actuator which is rearwardly depressible to act as a cover interlock and which is pivotable for test trip purposes.

These objects as well as other objects of this invention shall become readily apparent after reading the following description of the accompanying drawings in which:

FIG. 3 is a cross-section taken through line 3—3 of FIG. 1 looking in the direction of arrows 3—3 and showing the elements of the circuit breaker manual operating mechanism in contact closed position.

In FIG. 4 the common trip bar is in its normal or reset position and in FIG. 5 the bar is in the tripped position having been operated thereto by removal of the main cover.

FIG. 6 is a rear elevation of the common trip member looking in the direction of arrows 6—6 of FIG. 5 and FIG. 8.

FIG. 7 is a front elevation of the common trip member looking in the direction of arrows 7—7 of FIG. 5 and FIG. 8.

FIG. 8 is a side elevation of the common trip member looking in the direction of arrows 8—8 of FIG. 4.

FIG. 9 is a side elevation of the adjustment knob looking in the direction of arrows 9—9 of FIG. 5.

FIG. 10 is a plan view of the adjustment knob of FIG. 5.

Figure 1:
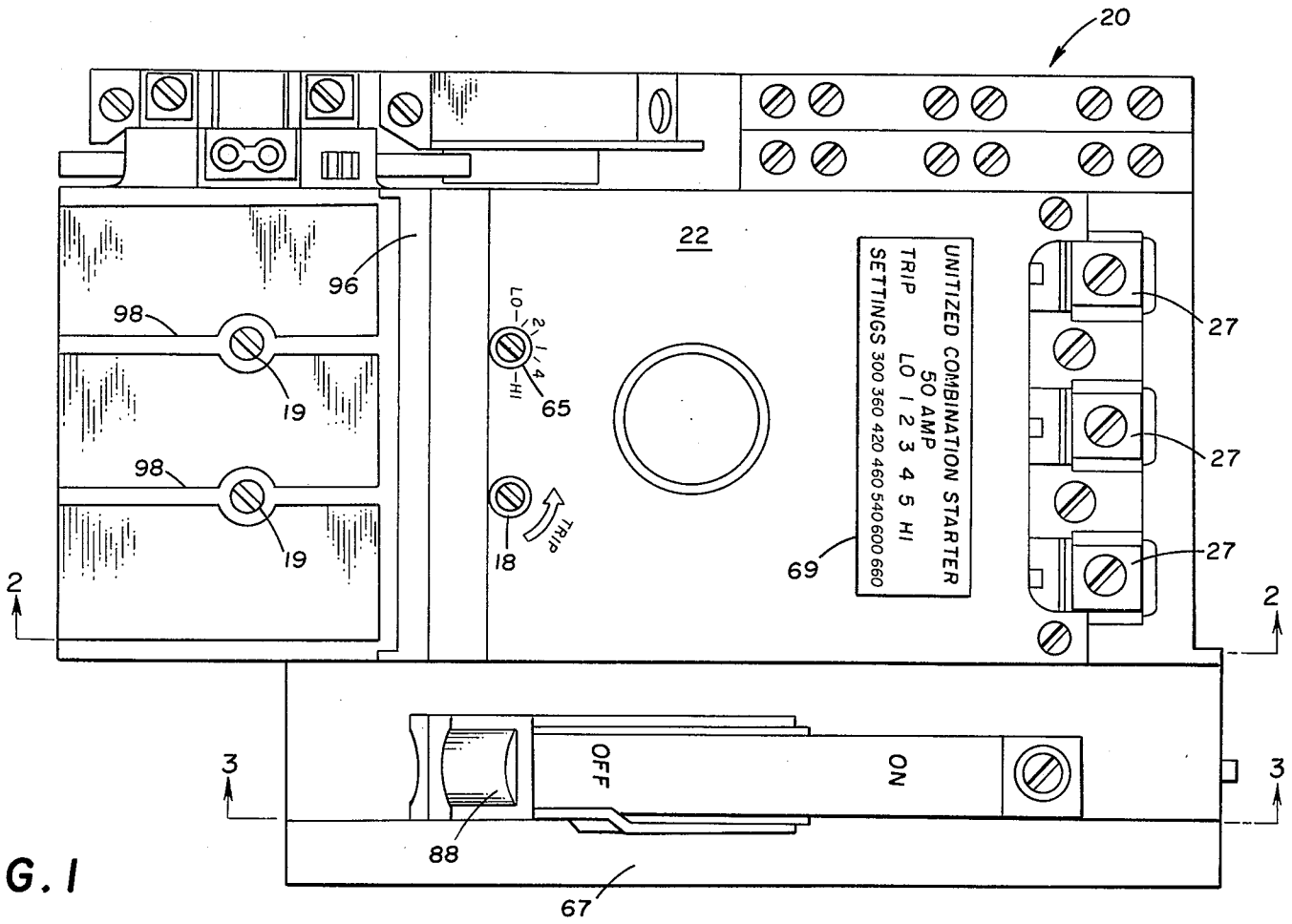
FIG. 1 is a plan view of a unitized combination motor starter including trip bar means constructed in accordance with teachings of the instant invention.

Now referring to the Figures. Unitized Combination motor starter 20 includes a molded insulating housing consisting of base 21 and removable shallow front cover 22 secured in operative position by screws 19. In a manner well known to the art, cover 22 includes internal longitudinally extending parallel ribs that mate with similar ribs in base 21 to form elongated parallel compartments. Three of these compartments have current carrying elements identical to those illustrated in the right hand portion of FIG. 2, and constitute a pole of the three pole circuit breaker portion 59 of starter 20. Removable side cover 67 is provided for the compartment which contains spring powered trip free contact operating mechanism 70 of FIG. 3.

Figure 2:
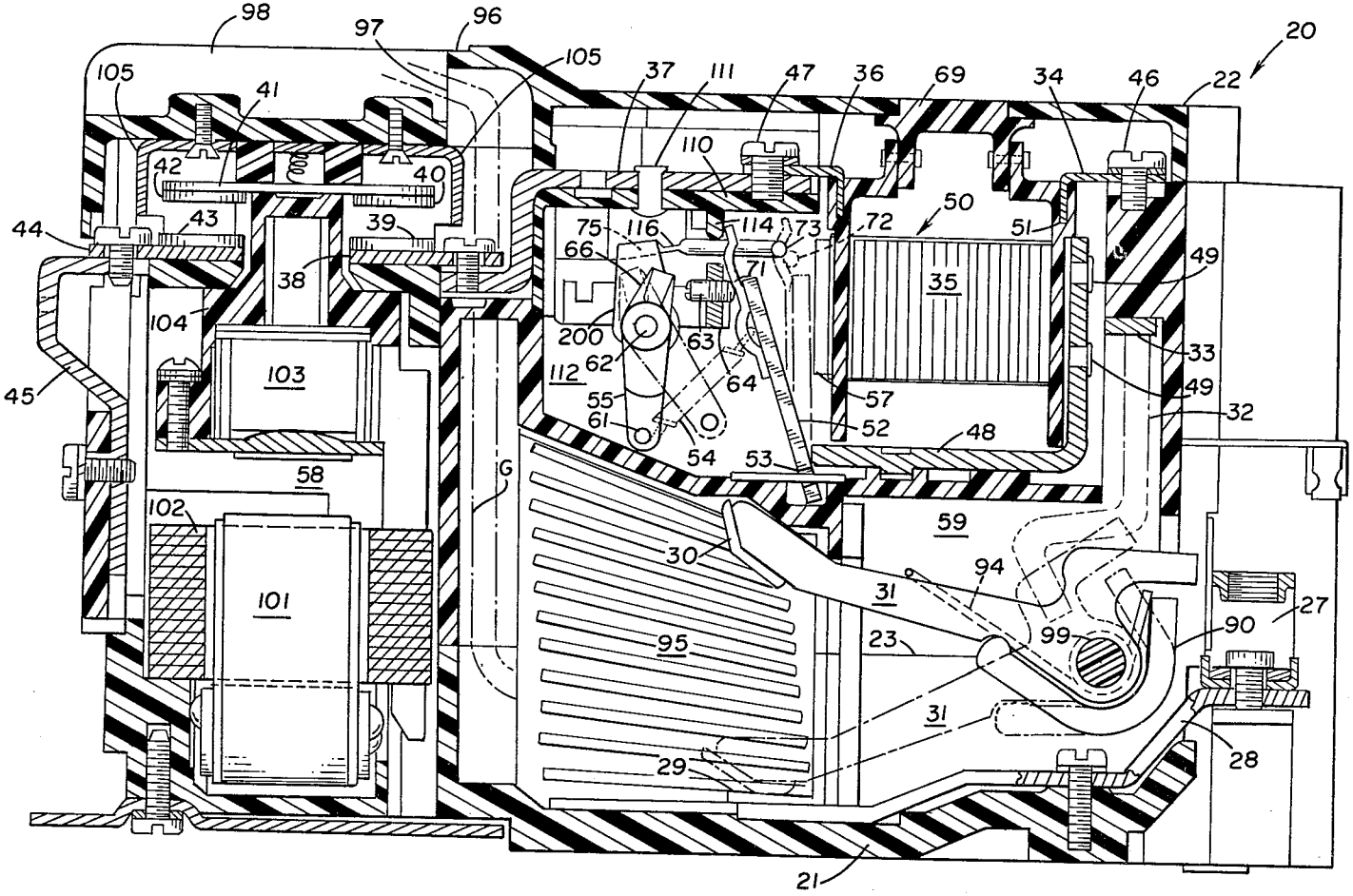
FIG. 2 is a cross-section taken through line 2—2 of FIG. 1 looking in the direction of arrows 2—2 and showing the elements of one pole unit.
Figure 5:
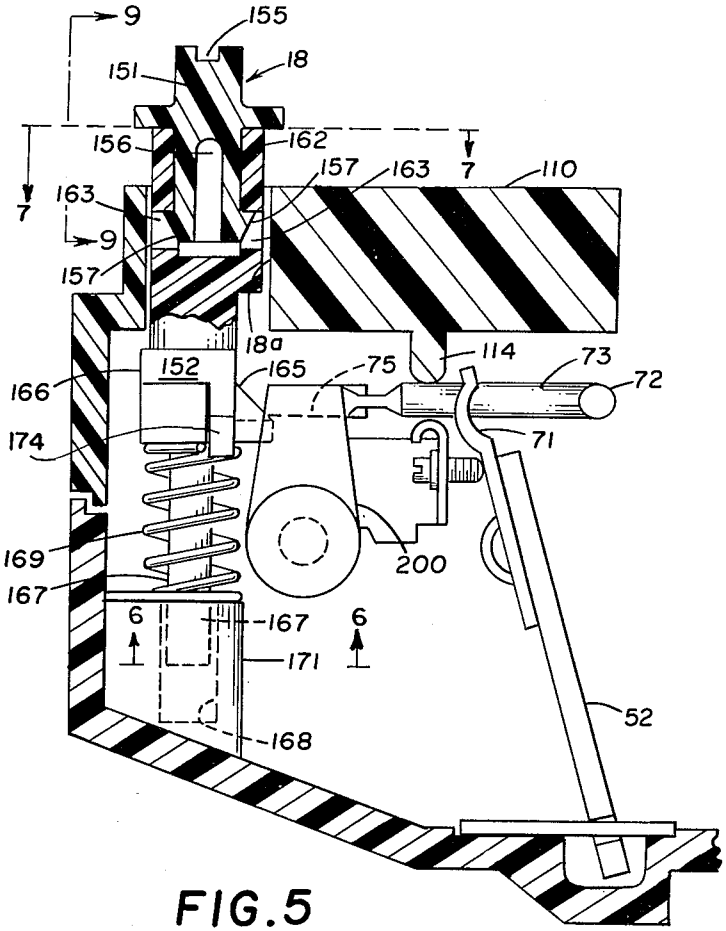
FIGS. 4 and 5 are fragmentary side elevations showing the relationship between selected elements of the trip unit.

The current carrying path for each of the three poles of starter 20 is identical so that only one of these paths shall be described with particular reference to FIG. 2. This current path includes wire grip 27 at one end of line terminal strap 28, strap 28, stationary contact 29 at the other end of strap 28, movable contact 30 at one end of movable contact arm 31, arm 31, flexible braid 32 at the other end of arm 31, U-shaped strap 33, coil terminal 34, coil 35, the other terminal 36 for coil 35, conducting straps 37 and 38, stationary contact 39 of electromagnetic contactor portion 58 of starter 20, movable contactor contact 40, conducting bridge 41, movable contactor contact 42, stationary contactor contact 43, conducting strap 44, and load terminal strap 45. The latter is constructed so as to be connectible directly to a load or to be connectible to a load through a conventional overload relay (not shown).

Coil 35 is part of circuit breaker calibrating assembly 50 removable and replaceable from the front of starter 20 after front cover 22 is removed. The calibrating assemblies 50 of all three poles may be individual units or they may be connected to a common insulating member 69 (FIG. 1) so that all three assemblies 50 must be removed as a unit.

Each subassembly 50 is electrically and mechanically secured in operative position by a pair of screws 46, 47 that are accessible when cover 22 is removed from base 21. Coil 35 is wound about bobbin 57 that surrounds one leg of stationary C-shaped magnetic frame 48. The latter is secured by rivets 49, 49 to insulator 51 having terminal 34 and bobbin 57 mounted thereto. The magnetic frame also includes movable armature 52 which is pivotally mounted at its lower end in the region indicated by reference numeral 53 so that the upper end of armature 52 may move toward and away from stationary frame portion 48. Coiled tension spring 54 is connected to pin formation 61 at the edge of adjusting bar 55 remote from its pivot provided by pins 62. Thus, spring 54 biases the forward end of armature 52 away from magnetic frame 48.

The air gap adjustment between armature 52 and frame 48 is set by screw 63 which is threadably mounted to transverse member 64. A cam (not shown) at the rear of pivotable adjusting control 65 engages extension 66 of member 55 to adjust the tension on all three springs 54 without changing the air gaps between any of the armatures 52 and their associated stationary frame sections 48. Control 65 extends through and is journalled for movement within a circular aperture (not shown) of auxiliary cover 110. As will be explained hereinafter in greater detail, turn-to-trip control 18 extends through and is journalled for movement within aperture 18*a* of auxiliary cover 110. Both controls 65 and 18 are accessible for operation through apertures in main cover 22.

Upon the occurrence of predetermined fault current conditions the flux generated by current flowing in coil 35 attracts armature 52 to stationary frame 48 causing bifurcated armature bracket 71 to engage enlarged formation 72 on transverse extension 73 of common tripper bar 75. The latter is part of tripper bar means 200 that pivots clockwise about an axis which coincides with axis 62 for adjusting bar 55 which causes screw 76 (FIG. 3) on tripper bar extension 77 to pivot latch member 78 in a clockwise or tripping direction about its pivot 79, thereby releasing latching point 81 of latch plate 951 on pivot 952 thereby releasing latching point 953 of cradle 80 so that the latter is free to pivot clockwise about pivot 82. As cradle 80 pivots clockwise, end 83 of upper toggle link 84 moves up and to the right with respect to FIG. 3 permitting coiled tension springs 86, connected between toggle knee 87 and manual operating handle 88 to collapse toggle 84, 85 and move handle 88 to the left. The latter is pivoted about center 89 through a connection between handle 88 and its rearward extension 91.

The lower end of toggle link 85 is pivotally connected at 92 to the free end of radial extension 93 of contact carrier 90. Thus, as toggle 84, 85 collapses carrier 90 is pivoted clockwise with respect to FIG. 3 and by so doing moves the contact arms 31 of all three poles to the solid line or open circuit position of FIG. 2. It is noted that base 21 is a multipart unit having sections which mate along dividing line 23 so that the reduced diameter bearing portions of contact carrier 90 may be inserted and capture in operative positions. In the closed positions of circuit breaker portion 59 an individual torsion spring 94, wound around rod 99 and interposed between carrier 90 and movable contact arm 31, biases arm 31 counterclockwise about insulating rod 99 as a center and thereby generates contact pressure.

For each pole of the three circuit breaker poles, an individual parallel plate arc chute 95 is provided to facilitate extinction of arcs drawn between circuit breaker contacts 29, 30 upon separation thereof. Arcing gases exiting from arc chute 95 at the left thereof with respect to FIG. 2 migrate forward as indicated by the dash lines G and are directed by hooded portion 96 of cover 22 to exit through opening 97 and flow to the left with respect to FIG. 2 in front of contactor section 58. External cover barriers 98 serve to prevent direct mixing of arcing gases from different poles at the instant these gases leave housing 21, 22 through exit openings 97.

The electrical and magnetic elements of contactor 58 are generally of conventional construction and include U-shaped magnetic yoke 101 whose arms are surrounded by portions of coil 102. When the latter is energized, armature 103 is attracted to yoke 101 and carries contact carrier 104 rearward. The latter mounts the bridging contacts 41 of all three poles so that contacts 41 move to their closed position wherein movable contacts 40, 42 engage the respective stationary contacts 39, 43. Steel elements 105 mounted to the inside of cover 22 are positioned in the regions of the contactor contacts 39, 40, 42, 43 whereby extinction of arcs drawn between these contacts upon separation thereof is facilitated through magnetic action.

Rivet 111 (FIG. 2) secures conducting strap 37 on the forward surface of insulating cover 110 of L-shaped cross-section. The latter forms the forward boundary for chamber 112 wherein common tripper bar 75, adjusting bar 55 and armatures 52 are disposed. After the removal of main cover 22, auxiliary cover 110 is removable for access to adjusting screws 63. The rear surface of cover 110 is provided with protrusions 114 which engage and guide movement of extensions 73. The latter are flexibly mounted to trip bar 75 at resilient reduced cross-section areas 116 which are constructed to bias extensions 73 forward.

As seen best in FIGS. 4 through 10, control 18 consists of knob 151 and actuator 152. Each of the elements 151, 152 is of one piece construction being molded of plastic material. Knob 151 includes cylindrical shaft section 153 having an annular shoulder 154 at a point intermediate the ends of cylindrical section 153. The forward end of section 153 is provided with slot 155 to receive a screw driver for pivoting control 18. The portion of section 153 to the rear of shoulder 154 is provided with longitudinally extending slot 156. Offset 90° from slot 156 are diametrically opposed outwardly extending tabs 157, 157 whose outer surfaces are slanted so that tabs 157 will be cammed inwardly during mounting of knob 151 to actuator 152, as will hereinafter be apparent. Normally the portion of knob 151 forward of shoulder 154 extends through circular aperture 18*b* of main cover 22 so that slot 155 is accessible from outside of cover 22.

Actuator 152 includes cylindrical bearing section 161 disposed within round bearing aperture 18*a* of auxiliary cover 110. Section 161 is provided with axial bore 162 that extends rearward from the forward end of actuator 152. Transverse apertures 163 extend outward from bore 162. When the rear end of knob 151 is inserted into bore 162 tabs 157 are initially pressed inward and then snap outward into apertures 163 to connect knob 151 and actuator 152 as a unitary structure. To the rear of bearing section 161, actuator 152 is provided with camming surface 165 and radial projection 166. Reduced diameter guide stem 167 extends to the rear of projection 166 into guide recess 168 in ledge 171 of base 21.

Stem 167 is surrounded by dual function coil spring 169. That is, spring 169 is loaded in compression by bearing against the forward surface of ledge 171 and the rear of projection 166 to bias control 18 forward. In addition, spring 169 is torsionally loaded with the rear end 172 thereof bearing against base surface 173 and the forward end of spring 169 bearing against surface 174 (FIG. 8) of projection 166 to bias control 18 clockwise with respect to FIG. 1. Normally the free end of projection 166 normally engages surface 176 of auxiliary cover 110 to limit clockwise movement of control 18.

Figure 4:
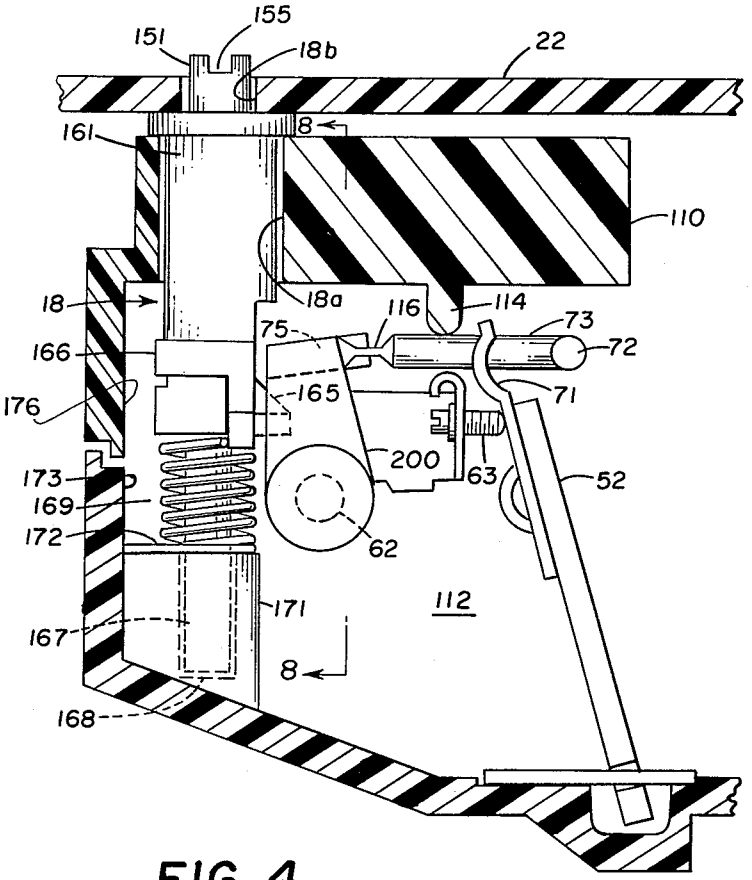

When main cover 22 is in its normal closed position, as in FIG. 4, the rear surface of cover 22 engages shoulder 154 and depresses control 18 to its inactive position. When cover 22 is open, as in FIG. 5, control 18 is moved forwardly by the force of spring 169. This brings cam surface 165 into engagement with common trip bar 75 causing the latter to move to the right and pivoting trip bar means 200 clockwise to its tripping position whereby the circuit breaker contacts 29, 30 are opened by mechanism 70.

With main cover 22 closed, radial projection 166 is aligned with trip bar 75. Thus, as control 18 is pivoted counterclockwise with respect to FIG. 1, projection 166 engages trip bar 75 moving the latter from left to right with respect to FIG. 4 to pivot trip bar means 200 in a clockwise direction thereby causing mechanism 70 to open circuit breaker contacts 29, 30. When control 18 is released, the torsional loading of spring 169 moves projection 166 away from trip bar 75 so as not to interfere with resetting of trip bar 75 to a non-trip position.

For more detailed descriptions of certain elements illustrated in the drawings reference is made to one or more of the following U.S. Pat. No. 4,088,973 issued May 9, 1978, U.S. Pat. No. 4,066,989 issued Jan. 3, 1978, U.S. Pat. No. 4,087,769 issued May 2, 1978 and U.S. Pat. No. 4,095,075 issued June 13, 1978.

Although a preferred embodiment of this invention has been described, many variations and modifications will now be apparent to those skilled in the art, and it is therefore preferred that the instant invention be limited not by the specific disclosure herein but only by the appending claims.

What is claimed is:

1. A multipole switching device including a set of cooperating contacts for each pole of said device, an operating mechanism for normally opening and closing said contacts, automatic trip means for operating said mechanism to open said contacts upon the occurrence of predetermined overload conditions; said mechanism including latch means which when latched permits said mechanism to open and close said contacts; said latch means when unlatched releasing a portion of said mechanism to open said contacts; said automatic trip means including a common trip means for all poles of said device; a housing wherein said contacts, said mechanism and said trip means are disposed; said housing including an openable front cover; a trip actuator; a spring urging said actuator forward; said actuator being maintained by said cover in a first position when the latter is closed; with said cover open said spring operating said actuator forward to a second position; said actuator in moving from said first to said second position operatively engaging said trip means for operation thereof to unlatch said latch means whereby said mechanism opens said contacts; with said cover closed, said actuator being accessible for operation from outside of said housing from said first to a third position to operatively engage said trip means for operation thereof to unlatch said latch means whereby said mechanism open said contacts; said actuator being provided with a first formation that operatively engages the trip means to unlatch the latch means when the actuator moves from said first to said second position; said actuator being provided with a second formation which operatively engages the trip means to unlatch the latch means when the actuator is operated to said third position; and said spring urging said actuator rotationally toward said first position.

2. A multipole switching device as set forth in claim 2 in which the spring is a coiled compression member which is compression loaded to urge said actuator forward and is torsionally loaded to urge said actuator toward said first position.

3. A multipole switching device as set forth in claim 1 in which the actuator is mounted for movement parallel to a pivot axis in moving between said first and second positions; said actuator when operated between said first and third positions pivoted about said pivot axis.

4. A multipole switching device as set forth in claim 3 in which the first formation is a forwardly facing cam surface and the second formation is an arm projecting radially from the pivot axis.

5. A multipole switching device as set forth in claim 4 in which the actuator includes first and second sections held in operative engagement by snap-fitting of cooperating formations; said first section including said first and second formations and said second section including a tool engageable portion located at an opening in said cover when the latter is closed.

6. A multipole switching device as set forth in claim 6 in which said spring is wound about said actuator.

7. A multipole switching device as set forth in claim 7 in which said spring is a coiled compression member which is compression loaded to urge said actuator forward and is torsionally loaded to urge said actuator toward said first position.

8. A multipole switching device as set forth in claim 7 in which the first formation is a forwardly facing cam surface and the second formation is an arm projecting radially from the pivot axis.

* * * * *